US009240140B2

(12) United States Patent
Choi

(10) Patent No.: US 9,240,140 B2
(45) Date of Patent: Jan. 19, 2016

(54) DISPLAY DEVICE, POWER SOURCE GENERATOR DEVICE, AND DRIVING METHOD OF AN OLED PIXEL

(71) Applicant: Samsung Display Co., Ltd., Yongin, Gyeonggi-Do (KR)

(72) Inventor: Hak-Ki Choi, Yongin (KR)

(73) Assignee: Samsung Display Co., Ltd., Yongin (KR)

( * ) Notice: Subject to any disclaimer, the term of this patent is extended or adjusted under 35 U.S.C. 154(b) by 113 days.

(21) Appl. No.: 13/900,424

(22) Filed: May 22, 2013

(65) Prior Publication Data

US 2014/0139506 A1 May 22, 2014

(30) Foreign Application Priority Data

Nov. 19, 2012 (KR) ..... 10-2012-0131188

(51) Int. Cl.
*G09G 3/32* (2006.01)
*G09G 3/36* (2006.01)

(52) U.S. Cl.
CPC ..... *G09G 3/3233* (2013.01); *G09G 3/3696* (2013.01); *G09G 2300/043* (2013.01); *G09G 2300/0852* (2013.01); *G09G 2320/043* (2013.01); *G09G 2320/045* (2013.01); *G09G 2330/00* (2013.01); *G09G 2330/028* (2013.01)

(58) Field of Classification Search
CPC . G09G 3/3696; G09G 3/3258; G09G 3/3233; G09G 3/3208; G09G 3/30; G09G 1/005; G09G 2330/028; G09G 2330/00; G09G 2320/043; G09G 2320/045; G09G 2300/0852
USPC ..... 345/20–779
See application file for complete search history.

(56) References Cited

U.S. PATENT DOCUMENTS

| | | | | |
|---|---|---|---|---|
| 2002/0172088 | A1* | 11/2002 | Iorio et al. | 365/230.06 |
| 2003/0107565 | A1* | 6/2003 | Libsch et al. | 345/211 |
| 2007/0268210 | A1* | 11/2007 | Uchino et al. | 345/55 |
| 2009/0002282 | A1* | 1/2009 | Tomida et al. | 345/76 |
| 2009/0140661 | A1* | 6/2009 | Park et al. | 315/169.3 |
| 2009/0184902 | A1* | 7/2009 | Tomida et al. | 345/77 |
| 2010/0053138 | A1* | 3/2010 | Im et al. | 345/211 |
| 2010/0220039 | A1* | 9/2010 | Park et al. | 345/76 |
| 2011/0018855 | A1* | 1/2011 | Miyazawa | 345/211 |
| 2011/0069059 | A1* | 3/2011 | Lee et al. | 345/212 |
| 2012/0169317 | A1* | 7/2012 | Shin | 323/311 |
| 2013/0207957 | A1* | 8/2013 | Lin et al. | 345/212 |
| 2013/0235010 | A1* | 9/2013 | Park | 345/209 |
| 2013/0335396 | A1* | 12/2013 | Kim | 345/212 |

FOREIGN PATENT DOCUMENTS

| | | |
|---|---|---|
| KR | 10-2005-0078959 (A) | 8/2005 |
| KR | 10-2005-0086073 (A) | 8/2005 |
| KR | 10-2012-0017305 (A) | 2/2012 |

* cited by examiner

*Primary Examiner* — Dwayne Bost
*Assistant Examiner* — Darlene M Ritchie
(74) *Attorney, Agent, or Firm* — Knobbe Martens Olson & Bear LLP

(57) ABSTRACT

A display device having a particular power controller circuit is disclosed. In one aspect, the display includes a plurality of pixels, and a power controller for supplying a first power source voltage and a second power source voltage for providing a driving current of the plurality of pixels wherein the power controller connects at least one of a first high level voltage, a ground, and a capacitor to a first node connected to the first power source voltage, and connects one of a second high level voltage and the ground to a second node connected to the second power source voltage.

13 Claims, 7 Drawing Sheets

DISPLAY DEVICE, POWER SOURCE GENERATOR DEVICE, AND DRIVING METHOD OF AN OLED PIXEL

CROSS-REFERENCE TO RELATED APPLICATIONS

This application claims priority to and the benefit of Korean Patent Application No. 10-2012-0131188 filed in the Korean Intellectual Property Office on Nov. 19, 2012, the entire contents of which are incorporated herein by reference.

BACKGROUND

1. Field

The disclosed technology relates to a display device, a power control device, and a driving method thereof.

2. Description of the Related Technology

A display device includes a display area formed of a plurality of pixels arranged in a matrix format. The display area includes a plurality of scan lines formed in a row direction and a plurality of data lines formed in a column line, and the plurality of scan lines and the plurality of data lines are arranged to cross each other. A power source voltage for driving a plurality of pixels is applied to the display area from a power supply device. Each of the plurality of pixels is driven by a scan signal and a data signal respectively transmitted from corresponding scan and data lines.

Recently, display areas for emerging technologies such as eletroluminescents have become wider to account for more applications that demand larger screens such as television sets. As the display area has become larger, the length of the power cable for transmitting a power voltage to the display area from the power supply device has gradually increased. As the length of the power cable grows, noise increases because of parasitic inductance and this negatively influences the operation of the internal circuitry of the display device.

SUMMARY OF CERTAIN INVENTIVE ASPECTS

The disclosed technology has been made in an effort to provide a display device for eliminating noise caused by parasitic inductance of a power cable, a power control device, and a driving method thereof.

An exemplary embodiment of the disclosed technology provides a display device, comprising: a plurality of pixels; and a power controller for supplying a first power source voltage and a second power source voltage for providing a driving current of the plurality of pixels, wherein the power controller connects at least one of a first high level voltage, a ground, and a capacitor to a first node connected to the first power source voltage, and connects one of a second high level voltage and the ground to a second node connected to the second power source voltage.

The power controller connects the first high level voltage to the first node and connects the ground to the second node so as to cause the pixels to emit light.

When the pixels emit light, the power controller blocks the connection between the second node and the ground and connects the capacitor to the first node so as to charge the capacitor.

The power controller connects the ground to the first node and connects the second high level voltage to the second node so as to reset a driving voltage of each organic light emitting diode (OLED) included in each of the pixels.

When resetting the driving voltage of the OLED, the power controller blocks the connection between the first node and the ground and connects the capacitor to the first node to discharge the capacitor.

The power controller connects the first high level voltage to the first node and connects the second high level voltage to the second node during a compensation period in which a threshold voltage of a driving transistor included in each of the pixels is compensated.

The power controller connects the first high level voltage to the first node and connects the second high level voltage to the second node during a scan period in which data are programmed in the pixels.

Another embodiment of the disclosed technology provides a power control device for a flat panel display, comprising: a first transistor configured to transmit a first high level voltage to a first node connected to a display including a plurality of pixels according to a first power source voltage control signal; a second transistor configured to ground the first node according to a second power source voltage control signal; a third transistor configured to transmit a second high level voltage to a second node connected to the display according to a third power source voltage control signal; a fourth transistor configured to ground the second node according to a fourth power source voltage control signal; and a fifth transistor configured to connect the first node to a capacitor according to a fifth power source voltage control signal.

The capacitor includes a first electrode connected to the fifth transistor and a second electrode connected to the ground.

The first transistor and the fourth transistor are turned on to cause the pixels to emit light.

The first transistor and the fourth transistor are turned on, the fourth transistor is turned off, and the fifth transistor is turned on to charge the capacitor.

When the fourth transistor is turned off and the fifth transistor is turned on, the third transistor is turned on and the fifth transistor is turned off.

When the third transistor is turned on and the fifth transistor is turned off, the first transistor is turned off and the second transistor is turned on to reset a driving voltage of each organic light emitting diode (OLED) included in each of the pixels.

When the first transistor is turned off and the second transistor is turned on, the second transistor is turned off and the fifth transistor is turned on to discharge in the capacitor.

When the second transistor is turned off and the fifth transistor is turned on, the first transistor is turned on and the fifth transistor is turned off.

At least one of the first transistor, the second transistor, the third transistor, the fourth transistor, and the fifth transistor is an oxide thin film transistor.

Yet another embodiment of the disclosed technology provides a method for driving a power control device including a first transistor for transmitting a first high level voltage to a first node connected to a display including a plurality of pixels, a second transistor for grounding the first node, a third transistor for transmitting a second high level voltage to a second node connected to the display device, a fourth transistor for grounding the second node, and a fifth transistor for connecting the first node to a capacitor, comprising: turning on the first transistor and the fourth transistor to cause the pixels to emit light; when the first transistor and the fourth transistor are turned on, turning off the fourth transistor and turning on the fifth transistor to charge the capacitor; and when the fourth transistor is turned off and the fifth transistor is turned on, turning on the third transistor and turning off the fifth transistor.

When the third transistor is turned on and the fifth transistor is turned off, the first transistor is turned off and the second transistor is turned on to reset a driving voltage of each organic light emitting diode (OLED) included in each of the pixels.

When the first transistor is turned off and the second transistor is turned on, the second transistor is turned off and the fifth transistor is turned on to discharge the capacitor.

When the second transistor is turned off and the fifth transistor is turned on, the first transistor is turned on and the fifth transistor is turned off.

According to the embodiments of the disclosed technology, noise caused by the parasitic inductance of the power cable is eliminated to acquire stability of the internal circuit of the display device.

DETAILED DESCRIPTION OF CERTAIN INVENTIVE EMBODIMENTS

Figure 1:
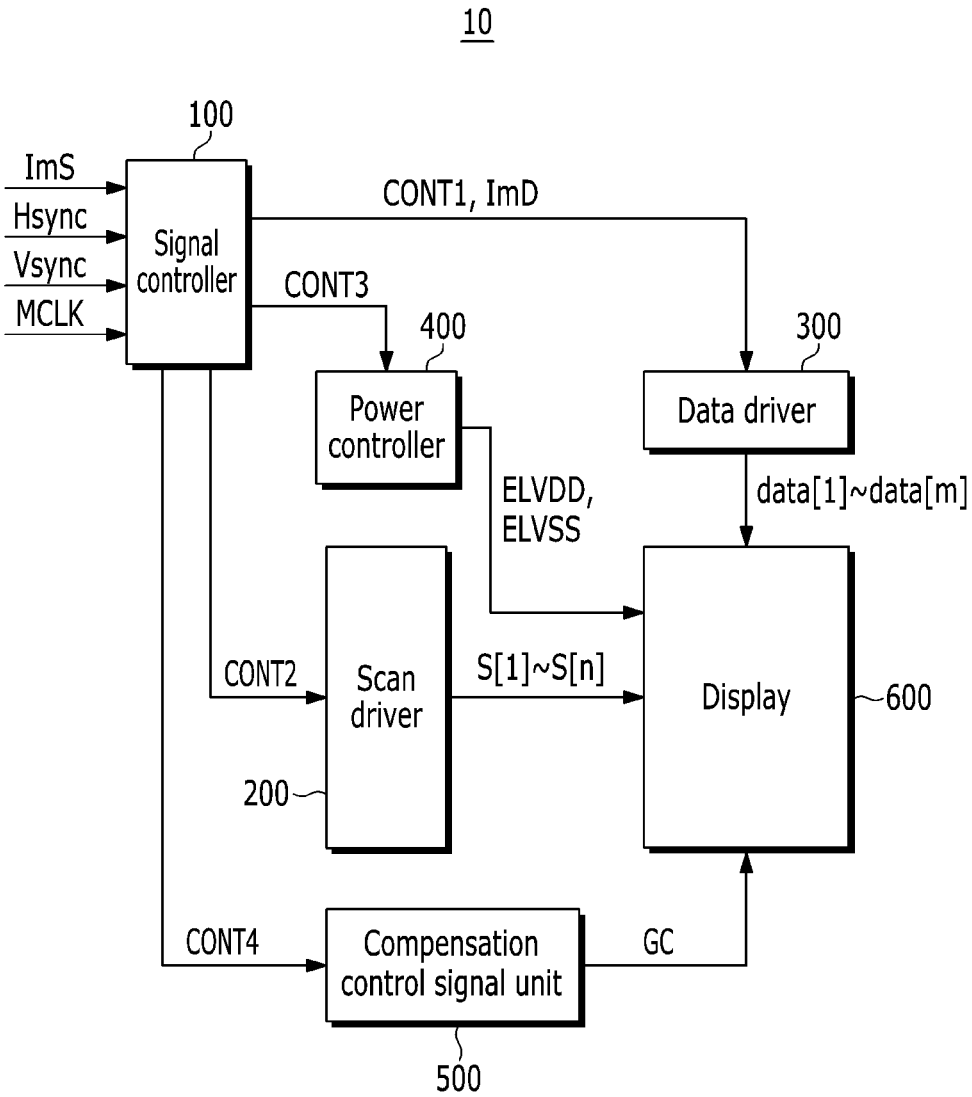
FIG. 1 shows a block diagram of a display device according to an exemplary embodiment of the disclosed technology.

Hereinafter, an exemplary embodiment of the disclosed technology will be described in detail with reference to the accompanying drawings so that a person of ordinary skill in the art may easily perform the disclosed technology. As those skilled in the art would realize, the described embodiments may be modified in various ways.

Further, in exemplary embodiments, since like reference numerals designate like elements having the same configuration, a first exemplary embodiment is representatively described, and in other exemplary embodiments, only a configuration different from the first exemplary embodiment will be described.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 shows a block diagram of a display device according to an exemplary embodiment of the disclosed technology.

Referring to FIG. 1, the display device 10 includes a signal controller 100, a scan driver 200, a data driver 300, a power controller 400, a compensation control signal unit 500, and a display 600.

The signal controller 100 receives a video signal (ImS) and a synchronization signal from an external device. The input video signal (ImS) includes luminance information on a plurality of pixels. The luminance has a predetermined number of grayscales, for example, $1024=2^{10}$, $256=2^{8}$, or $64=2^{6}$. The synchronization signal includes a horizontal synchronization signal (Hsync), a vertical synchronization signal (Vsync), and a main clock signal (MCLK).

The signal controller 100 generates first to fourth drive control signals (CONT1, CONT2, CONT3, and CONT4) and an image data signal (ImD) according to the video signal (ImS), the horizontal synchronization signal (Hsync), the vertical synchronization signal (Vsync), and the main clock signal (MCLK).

The signal controller 100 identifies the video signal (ImS) for each frame according to the vertical synchronization signal (Vsync) and identifies the video signal (ImS) for each scan line according to the horizontal synchronization signal (Hsync) to generate the image data signal (ImD). The signal controller 100 transmits the image data signal (ImD) together with the first drive control signal (CONT1) to the data driver 300.

The display 600 is a display area including a plurality of pixels. In the display 600, a plurality of scan lines substantially extend in a row direction and are substantially parallel to one another, a plurality of data lines substantially extend in a column direction and are substantially parallel to one another, a plurality of power lines, and a plurality of compensation control lines are formed to be connected to the pixels. The pixels are arranged in a matrix form in areas where the scan lines cross the data lines.

The scan driver 200 is connected to a plurality of scan lines and generates a plurality of scan signals (S[1]-S[n]) according to the second drive control signal (CONT2). The scan driver 200 sequentially applies the scan signals (S[1]-S[n]) with a gate-on voltage to a plurality of scan lines.

The data driver 300 is connected to a plurality of data lines, samples and holds the image data signal (ImD) according to the first drive control signal (CONT1), and transmits a plurality of data signals (data[1]-data[m]) to a plurality of data lines. The data driver 300 applies a data signal having a predetermined voltage range to a plurality of data lines corresponding to scan signals (S[1]-S[n]) with a gate-on voltage.

The power controller 400 determines levels of the first power source voltage (ELVDD) and the second power source voltage (ELVSS) according to the third drive control signal (CONT3), and supplies the same to a power line connected to a plurality of pixels. The first power source voltage (ELVDD) and the second power source voltage (ELVSS) provide a pixel driving current which causes light to be emitted.

The compensation control signal unit 500 determines a level of a compensation control signal (GC) according to the fourth drive control signal (CONT4) to apply it to the compensation control line connected to a plurality of pixels.

Figure 2:
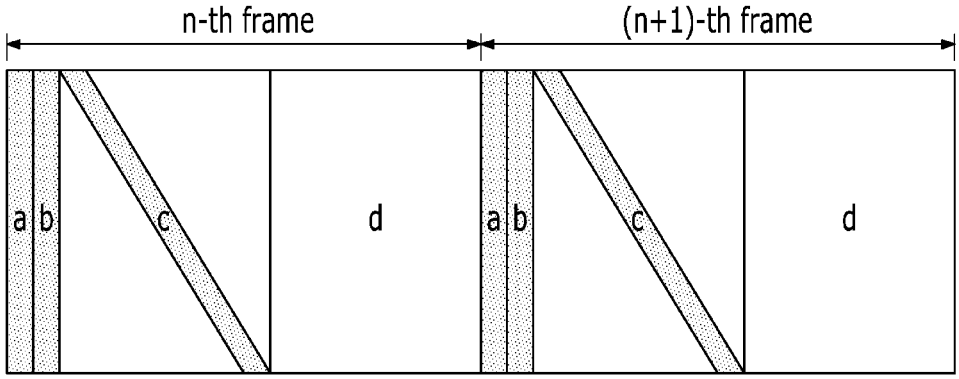
FIG. 2 shows a drive operation with a concurrent light emitting type of display device according to an exemplary embodiment of the disclosed technology.

FIG. 2 shows a drive operation with a concurrent light emitting type of display device according to an exemplary embodiment of the disclosed technology.

Referring to FIG. 2, the display device according to the embodiment of the disclosed technology will be assumed to be an organic light emitting diode (OLED) display, i.e., each pixel includes an OLED. However, the disclosed technology is not restricted thereto, and it is applicable to various sorts of display devices.

One frame period in which an image is displayed on the display 600 includes a reset period (a) for resetting a driving voltage of the OLED in each pixel, a compensation period (b) for compensating a threshold voltage of a driving transistor of each pixel, a scan period (c) for transmitting a data signal to at least a portion of the pixels, and a light emitting period (d) in which the pixels emit light corresponding to the transmitted data signal.

As shown, operations during the scan period (c) are sequentially performed for the respective scan lines, and the operations during the reset period (a), the threshold voltage compensation period (b), and the light emitting period (d) are simultaneously performed by the display 600.

Figure 3:
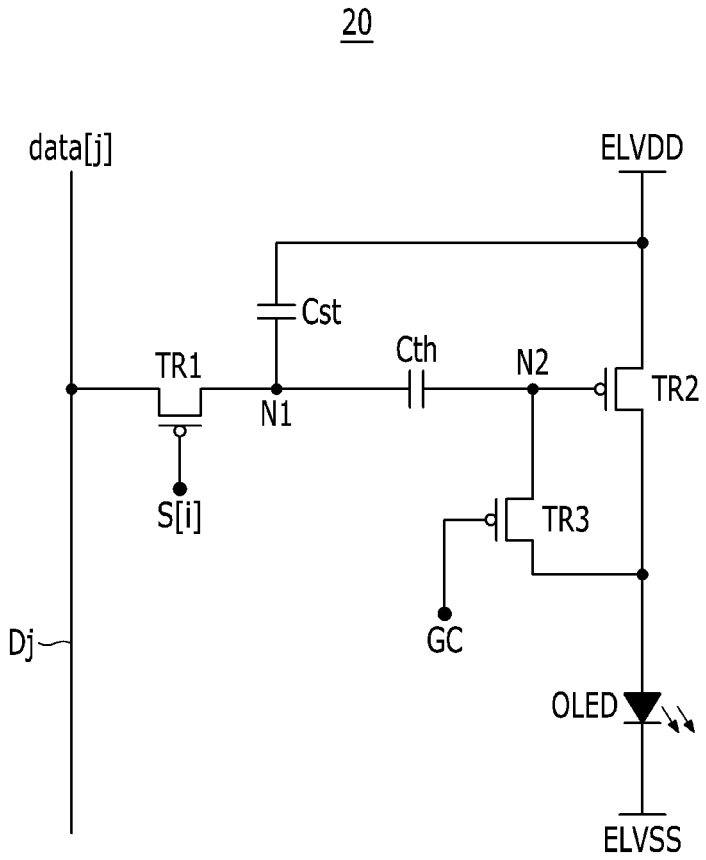
FIG. 3 shows a circuit diagram of a pixel according to an exemplary embodiment of the disclosed technology.

FIG. 3 shows a circuit diagram of a pixel according to an exemplary embodiment of the disclosed technology. It is the detail of one of the pixels included in the display device 10 of FIG. 1 and other pixels will be the same or have similar functionality.

Referring to FIG. 3, the pixel 20 includes a switching transistor TR1, a driving transistor TR2, a compensation transistor TR3, a compensation capacitor (Cth), a storage capacitor Cst, and an organic light emitting diode (OLED).

The switching transistor TR1 includes a gate electrode connected to a scan line, a first electrode connected to a data line (Dj), and a second electrode connected to a first node N1. The switching transistor TR1 is turned on by the scan signal (S[i]) with a gate-on voltage (Von) applied to the scan line, and transmits the data signal (data[j]) applied to the data line (Dj) to the first node N1.

The driving transistor TR2 includes a gate electrode connected to a second node N2, a first electrode connected to the first power source voltage (ELVDD), and a second electrode connected to an anode of the OLED. The driving transistor TR2 controls a driving current supplied to the OLED.

The compensation transistor TR3 includes a gate electrode connected to the compensation control line, a first electrode connected to the second node N2, and a second electrode connected to the anode of the OLED. The compensation transistor TR3 is turned on by the compensation control signal (GC) to diode-connect the driving transistor TR2.

The compensation capacitor (Cth) includes a first electrode connected to the first node N1 and a second electrode connected to the second node N2.

The storage capacitor Cst includes a first electrode connected to the first node N1 and a second electrode connected to the first power source voltage (ELVDD).

The OLED includes an anode connected to the second electrode of the driving transistor TR2 and a cathode connected to the second power source voltage (ELVSS). The OLED emits light with one of primary colors, for example. Typical primary colors that are used in display technologies are red, green and blue, and desired colors are displayed by a spatial sum or a temporal sum of the blended colors.

The switching transistor TR1, the driving transistor TR2, and the compensation transistor TR3 can be p-channel field effect transistors (FETs). In this instance, the gate-on voltage for turning on the switching transistor TR1, the driving transistor TR2, and the compensation transistor TR3 is a low level voltage, and a gate-off voltage for turning them off is a high level voltage.

The p-channel field effect transistors are shown in the present embodiment, and at least one of the switching transistor TR1, the driving transistor TR2, and the compensation transistor TR3 can be an n-channel field effect transistor. In this instance, the gate-on voltage for turning on the n-channel field effect transistor is a high level voltage and the gate-off voltage for turning it off is a low level voltage. In general, the transistors are formed as thin film transistors (TFTs) given modern production processes that exist.

Figure 4:
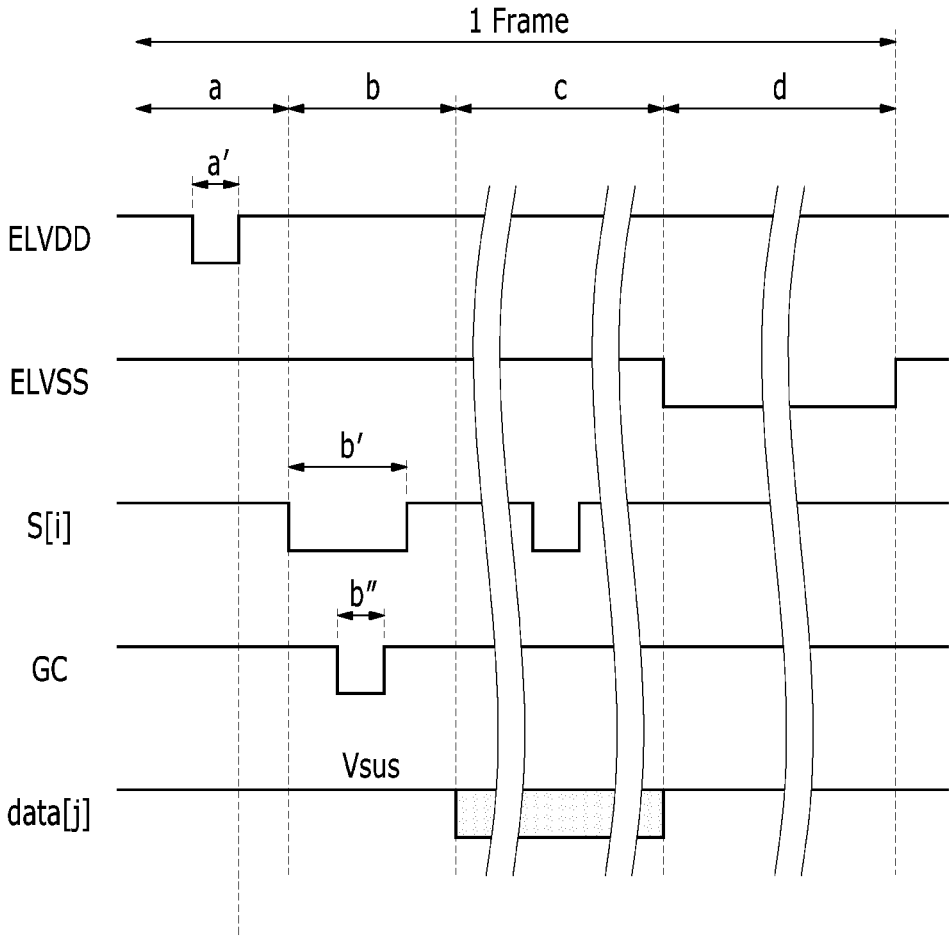
FIG. 4 shows a timing diagram of a driving method of a display device according to an exemplary embodiment of the disclosed technology.

FIG. 4 shows a timing diagram of a driving method of a display device according to an exemplary embodiment of the disclosed technology.

Referring to FIGS. 3 and 4, the second power source voltage (ELVSS) is maintained at a high level voltage during the reset period (a), and the first power source voltage (ELVDD) is applied as a low level voltage for a predetermined portion of the reset period which is shown as period (a'). In this instance, the scan signal (S[i]) and the compensation control signal (GC) are applied as a high level voltage. The data signal (data[j]) is applied as a sustain voltage (Vsus). The sustain voltage (Vsus) can be a high level voltage.

During the reset period (a), a voltage difference between the first power source voltage (ELVDD) and the second power source voltage (ELVSS) is reversed. Accordingly, an anode voltage of OLED becomes greater than the first power source voltage (ELVDD) with the low level voltage, and from the viewpoint of the driving transistor TR2, the anode of the OLED becomes a source. A gate voltage of the driving transistor TR2 is substantially similar to the first power source voltage (ELVDD), and an anode voltage of the OLED is a sum of the second power source voltage (ELVSS) and a voltage (substantially 0 to 3 V) stored in the OLED and it becomes much greater than the gate voltage of the driving transistor TR2. A gate-source voltage of the driving transistor TR2 becomes a sufficient negative voltage and the driving transistor TR2 is turned on. In this instance, a current flowing through the driving transistor TR2 flows to the first power source voltage (ELVDD) from the anode of the OLED and it flows until the anode voltage of the OLED reaches the first power source voltage (ELVDD) with a low level voltage.

Accordingly, during the reset period (a), a reset operation for the anode voltage of the OLED to be a low level voltage is performed.

When the OLED reset operation during the reset period (a) completes, the first power source voltage (ELVDD) is switched to a high level voltage.

During the compensation period (b), the scan signal (S[i]) is applied as a low level voltage for a predetermined first period (b') and the compensation control signal (GC) is applied as a low level voltage for a predetermined second period (b"). The second period (b") is included in the first period (b'). In this instance, the first power source voltage (ELVDD) and the second power source voltage (ELVSS) are maintained at the high level voltage. The data signal (data[j]) is applied to the pixel circuits as a sustain voltage (Vsus).

When the scan signal (S[i]) is applied as a low level voltage, the switching transistor TR1 is turned on and the data signal (data[j]) with the sustain voltage (Vsus) is transmitted to the first node N1 (FIG. 3). When the compensation control signal (GC) is applied as a low level voltage, the compensation transistor TR3 is turned on to diode-connect the driving transistor TR2. A voltage (ELVDD−Vth) that is generated by subtracting a threshold voltage (Vth) of the driving transistor TR2 from the first power source voltage (ELVDD) is supplied to the gate electrode of the driving transistor TR2. In this instance, a voltage (Vsus−ELVDD+Vth) corresponding to a voltage difference between the sustain voltage (Vsus) at the first node N1 and the voltage (ELVDD−Vth) at the second node N2 is charged in the compensation capacitor (Cth).

Therefore, during the compensation period (b), the compensation operation for charging the voltage that corresponds to the threshold voltage (Vth) of the driving transistor TR2 in the compensation capacitor (Cth) is performed.

When the compensation operation is finished during the compensation period (b), the scan signal (S[i]) and the compensation control signal (GC) are switched to a high level voltage.

During the scan period (c), a plurality of scan signals (S[1]-S[n]) are sequentially applied as a low level voltage to turn on the switching transistor TR1 of the pixel circuits being controlled by the scan signal at a respective scan line. While the switching transistor TR1 is turned on, the data signal (data[j]) is transmitted to the first node N1. In this instance, the first power source voltage (ELVDD) and the second power source voltage (ELVSS) are maintained at the high level voltage.

The second electrode of the compensation capacitor (Cth) is connected to the gate electrode of the driving transistor TR2 and it floats between on/off states. The voltage variation of the first node N1 is divided according to a capacitance ratio between the storage capacitor (Cst) and the compensation capacitor (Cth), and the voltage variation (dV) provided to the compensation capacitor (Cth) is reflected to the gate voltage of the driving transistor TR2. Hence, during the scan period (c), the gate voltage at the driving transistor TR2 becomes ELVDD−Vth+dV.

As described, during the scan period (c), the scan operation for the voltage that corresponds to the voltage variation (dV) caused by the data signal (data[j]) is reflected to the gate voltage of the driving transistor (Vth).

When the light emitting period (d) begins, the first power source voltage (ELVDD) maintains the high level voltage and the second power source voltage (ELVSS) is switched to the low level voltage.

When the first power source voltage (ELVDD) maintains the high level voltage and the second power source voltage (ELVSS) is switched to the low level voltage, the driving transistor TR2 generates a driving current caused by a difference between the source voltage and the gate voltage. The source voltage of the driving transistor TR2 is the first power source voltage (ELVDD) with a high level voltage and the gate voltage of the driving transistor TR2 is ELVDD−Vth+dV. The driving current of the driving transistor TR2 corresponds to the square of the voltage ({ELVDD−(ELVDD−Vth+dV)}−Vth=dV) that is generated by subtracting the threshold voltage (Vth) of the driving transistor TR2 from the voltage (ELVDD−(ELVDD−Vth+dV)). The latter voltage is generated by subtracting the gate voltage (ELVDD-VTH+dV) from the source voltage (ELVDD). That is, any unwanted deviation of the data signals caused by the threshold voltage deviation between the driving transistors TR2 of a plurality of pixels is not generated.

The described pixel configuration shown in FIG. 3 and the method for driving the display device shown in FIG. 4 are exemplary embodiments, and the proposed power control device is not restricted thereto. The proposed power control device is included in the display device including pixels configured in various ways to supply the first power source voltage (ELVDD) and the second power source voltage (ELVSS).

Figure 5:
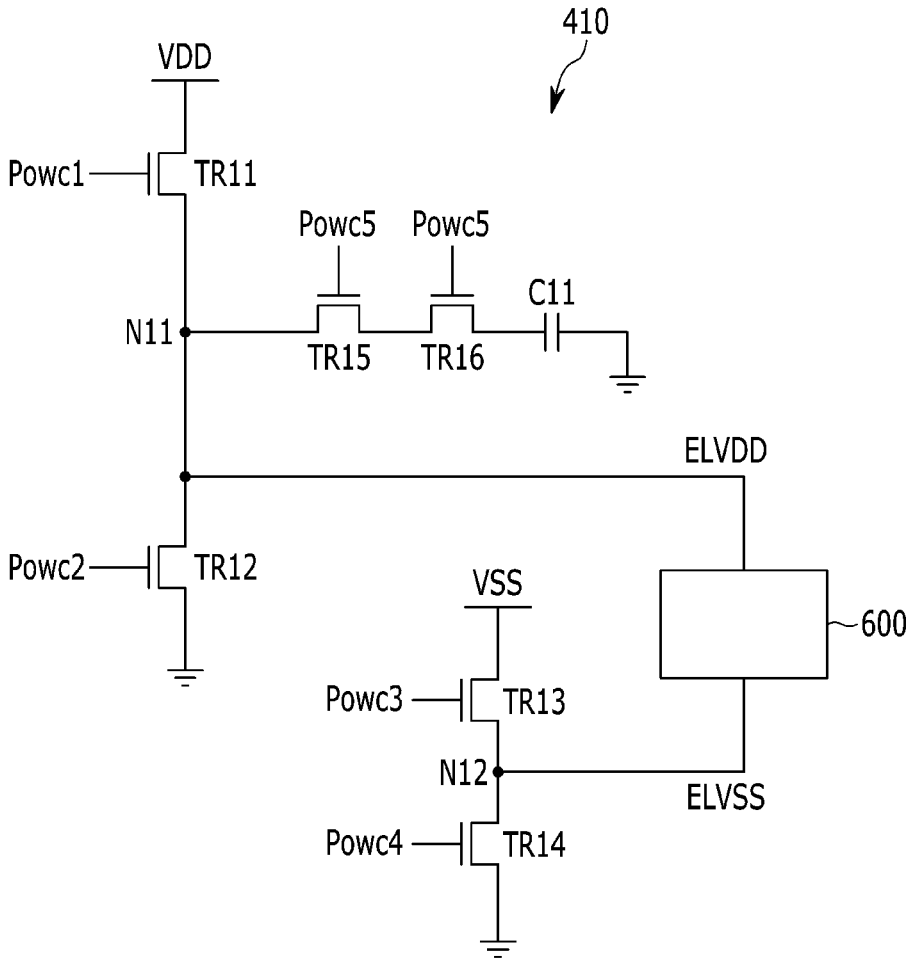
FIG. 5 shows a circuit diagram of a power control device according to an exemplary embodiment of the disclosed technology.

FIG. 5 shows a circuit diagram of a power control device according to an exemplary embodiment of the disclosed technology.

Referring to FIG. 5, the power control device 410 is included in the power controller 400 of FIG. 1. Since the general functionality of power controllers and circuitry layouts exist and are known by technologists, it would be understood how the device 410 would be incorporated therein.

The power control device 410 includes a first transistor TR11, a second transistor TR12, a third transistor TR13, a fourth transistor TR14, a fifth transistor TR15, a sixth transistor TR16, and a first capacitor C11.

The first transistor TR11 includes a gate electrode for receiving a first power source voltage control signal (Powc1), a first electrode connected to the first high level voltage VDD, and a second electrode connected to the first node N11.

The second transistor TR12 includes a gate electrode for receiving a second power source voltage control signal (Powc2), a first electrode connected to the first node N11, and a second electrode connected to a ground.

The third transistor TR13 includes a gate electrode for receiving a third power source voltage control signal (Powc3), a first electrode connected to the second high level voltage (VSS), and a second electrode connected to the second node N12.

The fourth transistor TR14 includes a gate electrode for receiving a fourth power source voltage control signal (Powc4), a first electrode connected to the second node N12, and a second electrode connected to the ground.

The fifth transistor TR15 includes a gate electrode for receiving the fifth power source voltage control signal (Powc5), a first electrode connected to the first node N12, and a second electrode connected to a first electrode of the sixth transistor TR16.

The sixth transistor TR16 includes a gate electrode for receiving a fifth power source voltage control signal (Powc5), the first electrode connected to the second electrode of the fifth transistor TR15, and a second electrode connected to a first electrode of the first capacitor C11.

The first capacitor C11 includes the first electrode connected to the second electrode of the sixth transistor TR16 and a second electrode connected to the ground.

The first to fifth power source voltage control signals (Powc1, Powc2, Powc3, Powc4, and Powc5) are included in the third drive control signal (CONT3) transmitted to the power controller 400.

The first node N11 is connected to the display 600, and the voltage at the first node N11 becomes the first power source voltage (ELVDD).

The second node N12 is connected to the display 600, and the voltage at the second node N12 becomes the second power source voltage (ELVSS).

In this embodiment, the first to sixth transistors (TR11, TR12, TR13, TR14, TR15, and TR16) are n-channel field effect transistors. In this instance, the gate-on voltage for turning on the first to sixth transistors (TR11, TR12, TR13, TR14, TR15, and TR16) is a high level voltage and the gate-off voltage for turning them off is a low level voltage.

The n-channel field effect transistors are shown, and at least one of the first to sixth transistors (TR11, TR12, TR13, TR14, TR15, and TR16) can be a p-channel field effect transistor. In this instance, the gate-on voltage for turning on the p-channel field effect transistor is a low level voltage and the gate-off voltage for turning it off is a high level voltage.

In some embodiments, the first to sixth transistors (TR11, TR12, TR13, TR14, TR15, and TR16) are made of one of an amorphous silicon thin film transistor (amorphous-Si TFT), a low temperature poly-silicon (LTPS) thin film transistor, and an oxide thin film transistor (oxide TFT).

The oxide thin film transistor (oxide TFT) can have an oxide that is made based on titanium (Ti), hafnium (Hf), zirconium (Zr), aluminum (Al), tantalum (Ta), germanium (Ge), zinc (Zn), gallium (Ga), tin (Sn), or indium (In), and complex oxides thereof such as zinc oxide (ZnO), indium-gallium-zinc oxide (InGaZnO4), indium-zinc oxide (Zn—In—O), zinc-tin oxide (Zn—Sn—O) indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), and hafnium-indium-zinc oxide (Hf—In—Zn—O) as an activation layer.

Figure 6:
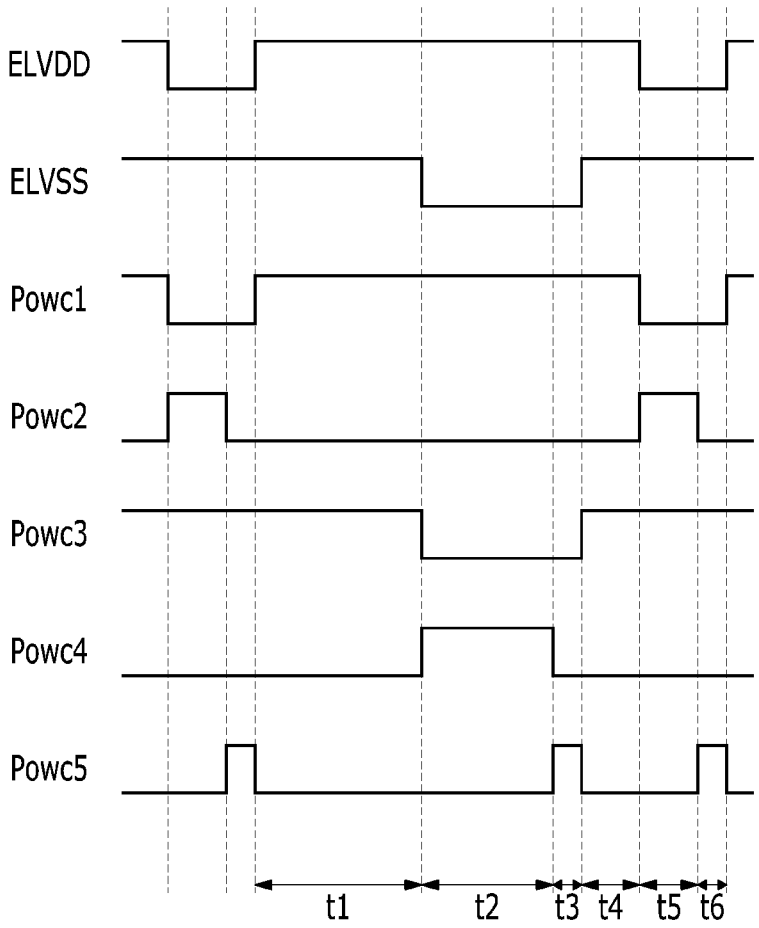
FIG. 6 shows a timing diagram of a method for driving a power control device according to an exemplary embodiment of the disclosed technology.

FIG. 6 shows a timing diagram of a method for driving a power control device according to an exemplary embodiment of the disclosed technology.

Referring to FIG. 6, during a period t1, a first power source voltage control signal (Powc1) and a third power source voltage control signal (Powc3) are applied as high level voltages, and a second power source voltage control signal (Powc2), a fourth power source voltage control signal (Powc4), and a fifth power source voltage control signal (Powc5) are applied as low level voltages. The first transistor TR11 is turned on by the first power source voltage control signal (Powc1), and the first high level voltage VDD is transmitted to the first node N11. The voltage at the first node N11 becomes a high level voltage. That is, the first power source voltage (ELVDD) is output as a high level voltage. The third transistor TR13 is turned on by the third power source voltage control signal (Powc3), and the second high level voltage (VSS) is transmitted to the second node N12. The voltage at the second node N12 becomes a high level voltage. That is, the second power source voltage (ELVSS) is output as a high level voltage.

The period t1 corresponds to a period from a predetermined period (a') in which the first power source voltage (ELVDD) is applied as a low level voltage to a light emitting period (d) in which the second power source voltage (ELVSS) is applied as a low level voltage in FIG. 4.

During the period t2, the first power source voltage control signal (Powc1) and the fourth power source voltage control signal (Powc4) are applied as high level voltages, and the second power source voltage control signal (Powc2), the third power source voltage control signal (Powc3), and the fifth power source voltage control signal (Powc5) are applied as low level voltages. The first transistor TR11 is turned on by the first power source voltage control signal (Powc1), and the first high level voltage VDD is transmitted to the first node N11. The voltage at the first node N11 is maintained at the high level voltage, and the first power source voltage (ELVDD) is output as the high level voltage. The third transistor TR13 is turned off by the third power source voltage control signal (Powc3). The fourth transistor TR14 is turned on by the fourth power source voltage control signal (Powc4), and the second node N12 is grounded. The ground voltage is a low level voltage. The voltage at the second node N12 is changed to a low level voltage. That is, the second power source voltage (ELVSS) is output as the low level voltage. In this instance, the current flows to the ground connected to the fourth transistor TR14 from the first high level voltage VDD through the first node N11 and the second node N12.

A period t3 is a period in which the fourth power source voltage control signal (Powc4) is applied as the low level voltage to turn off the fourth transistor TR14 before the third power source voltage control signal (Powc3) is applied as the high level voltage to turn on the third transistor TR13.

During the period t3, the first power source voltage control signal (Powc1) and the fifth power source voltage control signal (Powc5) are applied as the high level voltages, and the second power source voltage control signal (Powc2), the third power source voltage control signal (Powc3), and the fourth power source voltage control signal (Powc4) are applied as the low level voltages. The first transistor TR11 is turned on by the first power source voltage control signal (Powc1), and the first high level voltage VDD is transmitted to the first node N11. The voltage at the first node N11 is maintained at the high level voltage, and the first power source voltage (ELVDD) is output as the high level voltage. When the third power source voltage control signal (Powc3) and the fourth power source voltage control signal (Powc4) are applied as the low level voltages, the third transistor TR13 and the fourth transistor TR14 are turned off and the second node N12 maintains the low level voltage. In this instance, the fifth transistor TR15 and the sixth transistor TR16 are turned on by the fifth power source voltage control signal (Powc5), and the high level voltage at the first node N11 is transmitted to the first capacitor C11. That is, the current flows to the first capacitor C11 from the first high level voltage VDD, and the first capacitor C11 is charged with charges.

Figure 7:
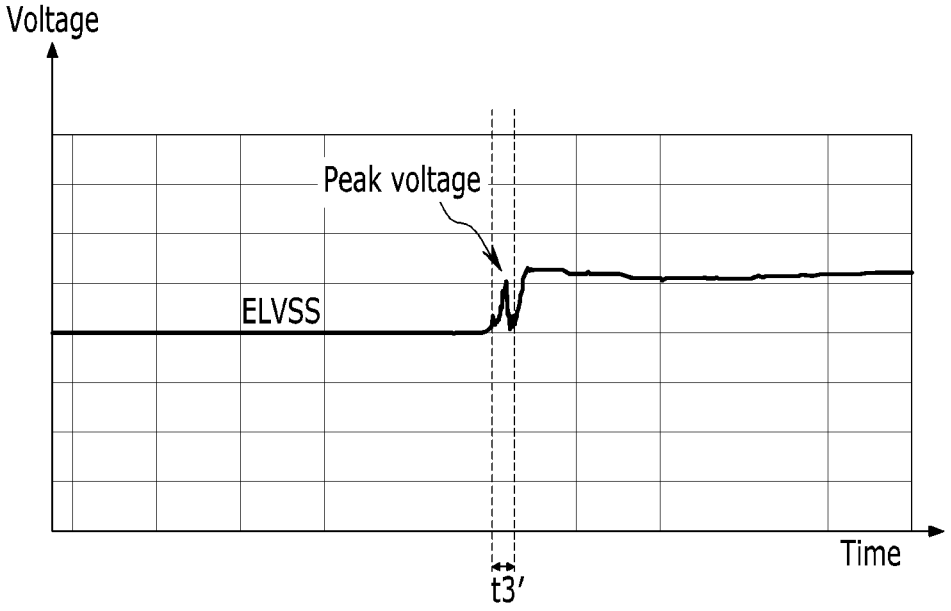
FIG. 7 shows a graph for testing a voltage variation of a second power source voltage (ELVSS) caused by parasitic inductance when a fourth transistor is turned off.

In circuits where the fifth transistor TR15, the sixth transistor TR16, and the first capacitor C11 are not included, during the period t2, a current path that starts from the first high level voltage VDD, passes through the first node N11 and the second node N12, and ends at the ground connected to the fourth transistor TR14. The current disappears during the period t3 when the fourth transistor TR14 is turned off. However, noise caused by the parasitic inductance of the power cable for connecting the power control device 410 and the display 600 is generated. That is, when the fourth transistor TR14 is turned off by the parasitic inductance and the current path disappears, the current flows in the second node N12 direction from the first high level voltage VDD. FIG. 7 shows a graph for testing a voltage variation of a second power source voltage (ELVSS) caused by parasitic inductance when a fourth transistor (TR14) is turned off. Referring to FIG. 7, it is found that a peak voltage appears by the parasitic inductance when the fourth transistor TR14 is turned off at (t3') before the third transistor TR13 is turned on. When the peak voltage is excessive, the internal circuitry of the display device 10, such as the fourth transistor TR14, may be damaged.

Referring to FIG. 6, the power control device 410 connects the first node N11 to the first capacitor C11 during the period t3 so that the current may flow to the first capacitor C11 from the first high level voltage VDD. Therefore, generation of the peak voltage caused by the flowing of the current in the second node N12 direction from the first high level voltage VDD is prevented.

During the period t4, the first power source voltage control signal (Powc1) and the third power source voltage control signal (Powc3) are applied as high level voltages, and the second power source voltage control signal (Powc2), the fourth power source voltage control signal (Powc4), and the fifth power source voltage control signal (Powc5) are applied as low level voltages. The first transistor TR11 is turned on by the first power source voltage control signal (Powc1), and the first high level voltage VDD is transmitted to the first node N11. The voltage at the first node N11 becomes a high level voltage, and the first power source voltage (ELVDD) is output as a high level voltage. The third transistor TR13 is turned on by the third power source voltage control signal (Powc3), and the second high level voltage (VSS) is transmitted to the second node N12. The voltage at the second node N12 becomes a high level voltage, and the second power source voltage (ELVSS) is output as a high level voltage.

During the period t5, the second power source voltage control signal (Powc2) and the third power source voltage control signal (Powc3) are applied as high level voltages, and the first power source voltage control signal (Powc1), the fourth power source voltage control signal (Powc4), and the fifth power source voltage control signal (Powc5) are applied as low level voltages. The first transistor TR11 is turned off by the first power source voltage control signal (Powc1). The second transistor TR12 is turned on by the second power source voltage control signal (Powc2), and the first node N11 is connected to the ground. The voltage at the first node N11 becomes a low level voltage, and the first power source voltage (ELVDD) is output as a low level voltage. The third transistor TR13 is turned on by the third power source voltage control signal (Powc3), and the second high level voltage (VSS) is transmitted to the second node N12. The voltage at the second node N12 becomes a high level voltage, and the second power source voltage (ELVSS) is output as a high level voltage.

During the period t6, the second power source voltage control signal (Powc2) is applied as a low level voltage to turn off the second transistor TR12 before the first power source voltage control signal (Powc1) is applied as a high level voltage to turn on the first transistor TR11.

During the period t6, the third power source voltage control signal (Powc3) and the fifth power source voltage control signal (Powc5) are applied as high level voltages, and the first power source voltage control signal (Powc1), the second power source voltage control signal (Powc2), and the fourth power source voltage control signal (Powc4) are applied as low level voltages. The first transistor TR11 is turned off by the first power source voltage control signal (Powc1), and the second transistor TR12 is turned off by the second power source voltage control signal (Powc2). In this instance, the fifth transistor TR15 and the sixth transistor TR16 are turned on by the fifth power source voltage control signal (Powc5) to connect the first capacitor C11 to the first node N11. The charges stored in the first capacitor C11 are discharged. The third transistor TR13 is turned on by the third power source voltage control signal (Powc3), and the second high level voltage (VSS) is transmitted to the second node N12. The voltage at the second node N12 becomes a high level voltage, and the second power source voltage (ELVSS) is output as a high level voltage.

The time function of the capacitor C11 will now be described. The period t3 is a very short period for turning off the fourth transistor TR14 before the third transistor TR13 is turned on, and the period t6 is a very short period for turning off the second transistor TR12 before the first transistor TR11 is turned on. Charges are stored in the first capacitor C11 during the period t3 and the charges stored in the first capacitor C11 are discharged during the period t6 so capacitance of the first capacitor C11 will be sufficient when the first capacitor C11 is charged or discharged for a short time.

When the charges stored in the first capacitor C11 are discharged in the period t6, the discharged amount of charge is less so the increase of the first power source voltage (ELVDD) to the high level voltage becomes the time when the first power source voltage control signal (Powc1) is applied as the high level voltage and the first transistor TR11 is turned on.

The foregoing referenced drawings and detailed description of the present invention are all exemplary and are used for explaining the present invention, and do not limit the meaning or the scope of the present invention defined in the claims. Accordingly, those skilled in the art will appreciate that various modifications and equivalent another embodiment may be possible. Accordingly, the true technical protection scope of the present invention will be defined by the technical spirit of the accompanying claims.

What is claimed is:

1. A display device, comprising:

a plurality of pixels;

an organic light-emitting diode (OLED) included in each of the pixels; and a power controller including a capacitor for eliminating noise caused by parasitic inductance of a power cable and configured to supply a first power source voltage and a second power source voltage for providing a driving current of the plurality of pixels, wherein the power controller connects at least one of a first high level voltage, a ground, and the capacitor to a first node connected to the first power source voltage, and connects one of a second high level voltage and the ground to a second node connected to the second power source voltage;

wherein the power controller connects the first high level voltage to the first node and connects the ground to the second node so as to cause the pixels to emit light;

wherein, when the pixels emit light, the power controller blocks the connection between the second node and the ground and connects the capacitor to the first node so as to charge the capacitor;

wherein when the power controller connects the ground to the first node and connects the second high level voltage to the second node so as to reset a driving voltage of each OLED then the power controller blocks the connection between the first node and the ground and connects the capacitor to the first node to discharge the capacitor.

2. The display device of claim 1, wherein the power controller connects the first high level voltage to the first node and connects the second high level voltage to the second node during a compensation period in which a threshold voltage of a driving transistor included in each of the pixels is compensated.

3. The display device of claim 1, wherein the power controller connects the first high level voltage to the first node and connects the second high level voltage to the second node during a scan period in which data are programmed in the pixels.

4. A power control device for a flat panel display, comprising:

a capacitor for eliminating noise caused by parasitic inductance of a power cable;

a first transistor configured to transmit a first high level voltage to a first node connected to a display including a plurality of pixels according to a first power source voltage control signal;

a second transistor configured to ground the first node according to a second power source voltage control signal;

a third transistor configured to transmit a second high level voltage to a second node connected to the display according to a third power source voltage control signal;

a fourth transistor configured to ground the second node according to a fourth power source voltage control signal; and a fifth transistor configured to connect the first node to a capacitor according to a fifth power source voltage control signal, wherein the capacitor includes a first electrode connected to the fifth transistor and a second electrode directly connected to the ground, and wherein when the first transistor is turned off and the second transistor is turned on, then the second transistor is turned off and the fifth transistor is turned on to discharge the capacitor.

5. The power control device of claim 4, wherein at least one of the first transistor, the second transistor, the third transistor, the fourth transistor, and the fifth transistor is an oxide thin film transistor.

6. The power control device of claim 4, wherein the first transistor and the fourth transistor are turned on to cause the pixels to emit light.

7. The power control device of claim 4, wherein when the first transistor and the fourth transistor are turned on, then the fourth transistor is turned off, and the fifth transistor is turned on to charge the capacitor.

8. The power control device of claim 4, wherein when the third transistor is turned on and the fifth transistor is turned off, then the first transistor is turned off and the second transistor is turned on to reset a driving voltage of each organic light emitting diode (OLED) included in each of the pixels.

9. The power control device of claim 8, wherein when the second transistor is turned off and the fifth transistor is turned on, then the first transistor is turned on and the fifth transistor is turned off.

10. A method for driving a power control device including a capacitor for eliminating noise caused by parasitic inductance of a power cable, a first transistor for transmitting a first high level voltage to a first node connected to a display including a plurality of pixels, a second transistor for grounding the first node, a third transistor for transmitting a second high level voltage to a second node connected to the display device, a fourth transistor for grounding the second node, and a fifth transistor for connecting the first node to the capacitor, comprising:

turning on the first transistor and the fourth transistor to cause the pixels to emit light;

when the first transistor and the fourth transistor are turned on, turning off the fourth transistor and turning on the fifth transistor to charge the capacitor; and when the fourth transistor is turned off and the fifth transistor is turned on, turning on the third transistor and turning off the fifth transistor.

11. The method of claim 10, wherein when the third transistor is turned on and the fifth transistor is turned off, then the first transistor is turned off and the second transistor is turned on to reset a driving voltage of each organic light emitting diode (OLED) included in each of the pixels.

12. The method of claim 11, wherein when the first transistor is turned off and the second transistor is turned on, then the second transistor is turned off and the fifth transistor is turned on to discharge the capacitor.

13. The method of claim 12, wherein when the second transistor is turned off and the fifth transistor is turned on, then the first transistor is turned on and the fifth transistor is turned off.

* * * * *